US008242414B2

(12) United States Patent
Hasslberger et al.

(10) Patent No.: US 8,242,414 B2
(45) Date of Patent: Aug. 14, 2012

(54) DOMESTIC APPLIANCE COMBINATION

(75) Inventors: Robert Hasslberger, Ruhpolding (DE); Jürgen Schuchhardt, Elmshorn (DE); Nesrin Schuchhardt, legal representative, Elmshorn (DE); Bünyamin Schuchhardt, legal representative, Elmshorn (DE); Marvin Schuchhardt, legal representative, Elmshorn (DE); Markus Theine, Freilassing (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1023 days.

(21) Appl. No.: 12/077,292

(22) Filed: Mar. 18, 2008

(65) Prior Publication Data

US 2009/0183360 A1 Jul. 23, 2009

(30) Foreign Application Priority Data

Mar. 20, 2007 (DE) ..... 10 2007 013 318

(51) Int. Cl.

| | |
|---|---|
| ***F24C 11/00*** | (2006.01) |
| ***A21B 1/00*** | (2006.01) |
| ***A21B 3/00*** | (2006.01) |
| ***A47B 96/06*** | (2006.01) |
| ***F16B 1/00*** | (2006.01) |

(52) U.S. Cl. ..... 219/394; 248/229.1; 248/309.1; 248/500; 126/273 R

(58) Field of Classification Search ..... None
See application file for complete search history.

(56) References Cited

U.S. PATENT DOCUMENTS

| | | | | | |
|---|---|---|---|---|---|
| 3,180,331 | A | * | 4/1965 | Jenn et al. | 126/21 A |
| 3,557,895 | A | * | 1/1971 | Thomas | 180/68.5 |
| 4,180,049 | A | * | 12/1979 | Carr et al. | 126/21 A |
| 4,966,346 | A | * | 10/1990 | Karna et al. | 248/503 |
| 5,926,886 | A | * | 7/1999 | Braunschweig et al. | 8/158 |
| 2006/0010934 | A1 | * | 1/2006 | Kim | 68/3 R |
| 2008/0308709 | A1 | * | 12/2008 | Tartan et al. | 248/678 |

FOREIGN PATENT DOCUMENTS

| | | | |
|---|---|---|---|
| DE | 2332805 | A * | 1/1975 |
| DE | 102005026134 | A1 * | 12/2006 |
| JP | 59189220 | A * | 10/1984 |

* cited by examiner

*Primary Examiner* — Joseph M Pelham
(74) *Attorney, Agent, or Firm* — James E. Howard; Andre Pallapies

(57) ABSTRACT

A domestic appliance combination comprising at least a first domestic appliance and a second domestic appliance arranged thereabove is disclosed, these being connected to one another for installation into a common built-in housing, with the second domestic appliance being connected to the first domestic appliance by means of a clamp-connection. A method for connecting at least two domestic appliances one above the other is also disclosed, which comprises a step involving fastening the second domestic appliance by means of a clamp-connection.

20 Claims, 4 Drawing Sheets

DOMESTIC APPLIANCE COMBINATION

BACKGROUND OF THE INVENTION

The invention relates to two domestic appliance combinations and method for connecting two domestic appliances.

Certain domestic appliances, e.g. a refrigerator and a freezer were previously conventionally connected by means of screws and then inserted into a common built-in housing.

However, ovens which are arranged one above the other, between which a heat decoupling is conventionally desired, were hitherto combined such that two 'complete' devices—i.e., with their own built-in housing, are connected to one another by way of fixed connections such as screw joints, welded joints, bolts etc. The respective built-in housings together with the air duct afforded thereby provide the desired heat decoupling. However, such a solution requires a comparatively large amount of installation space, is expensive in terms of assembly and is comparatively time-consuming in terms of maintenance and repairs.

BRIEF SUMMARY OF THE INVENTION

It is thus an object of the present invention to provide a comparatively compact domestic appliance combination, which is simple to assemble, cost-effective and provides as uniform an exterior design as possible. The domestic appliance combination should advantageously also be able to provide a possibility for heat decoupling in the domestic appliances.

The object is achieved by a domestic appliance combination comprising at least one first domestic appliance and second domestic appliance arranged thereabove, which are connected to one another for installation in a common built-in housing, with the second domestic appliance being connected to the first domestic appliance by means of a clamp-connection. A screwing step can be dispensed with as a result of the clamp-connection, thereby simplifying assembly. In case a service call is required (e.g. maintenance or repair), a clamp-connection can frequently be easily released and reassembled with a few manual operations so that the upper domestic appliance can be easily removed, namely either for its repair/maintenance or to provide access to the first domestic appliance. Installation in a common built-in housing produces a compact construction particularly for ovens.

It is advantageous for the simple constructive realization and operation for the clamp-connection to include a clamping bracket disposed on the second domestic appliance.

It is also advantageous if a support construction is present between the first domestic appliance and the second domestic appliance, said support construction being supported by the first domestic appliance and supporting the second domestic appliance. A heat decoupling can be assisted for instance and vibrations etc. can also be decoupled. The clamp-connection can connect the first and second domestic appliance directly, e.g. by attachment to side panels of the first domestic appliance. It is however advantageous if the clamp-connection is mounted on the support construction and thus indirectly connects the first domestic appliance to the second domestic appliance.

It is particularly advantageous for compact heat decoupling if the support construction forms at least one part of an air channel of the second domestic appliance.

It is advantageous for the cooling process if air channels are mounted on the second domestic appliance.

It is advantageous, particularly for an oven combination comprising especially an oven and a microwave oven arranged thereabove, if these are set up for installation into a common built-in housing. This represents an independent inventive point of view for ovens.

It is also advantageous if the domestic appliance combination is built into a common built-in housing.

The invention is also achieved by a method for connecting at least two domestic appliances one on top of the other, which has a step which involves fastening the second domestic appliance by means of a clamp-connection.

The following steps advantageously precede the fastening step: attaching a support construction to the first domestic appliance, which is set up to accommodate the second domestic appliance; and attaching the second domestic appliance to the support construction; with the fastening step involving fastening the second domestic appliance to the support construction by means of the clamp-connection.

The method is particularly advantageous if it also includes the step of inserting the domestic appliance into a common built-in housing.

BRIEF DESCRIPTION OF THE DRAWINGS

The invention is described schematically in more detail below with reference to an exemplary embodiment. The exemplary embodiment is not to be regarded here as restrictive for the invention. Identical or identically-functioning parts are continuously provided with the same reference characters.

DETAILED DESCRIPTION OF THE PRESENT INVENTION

Figure 1:
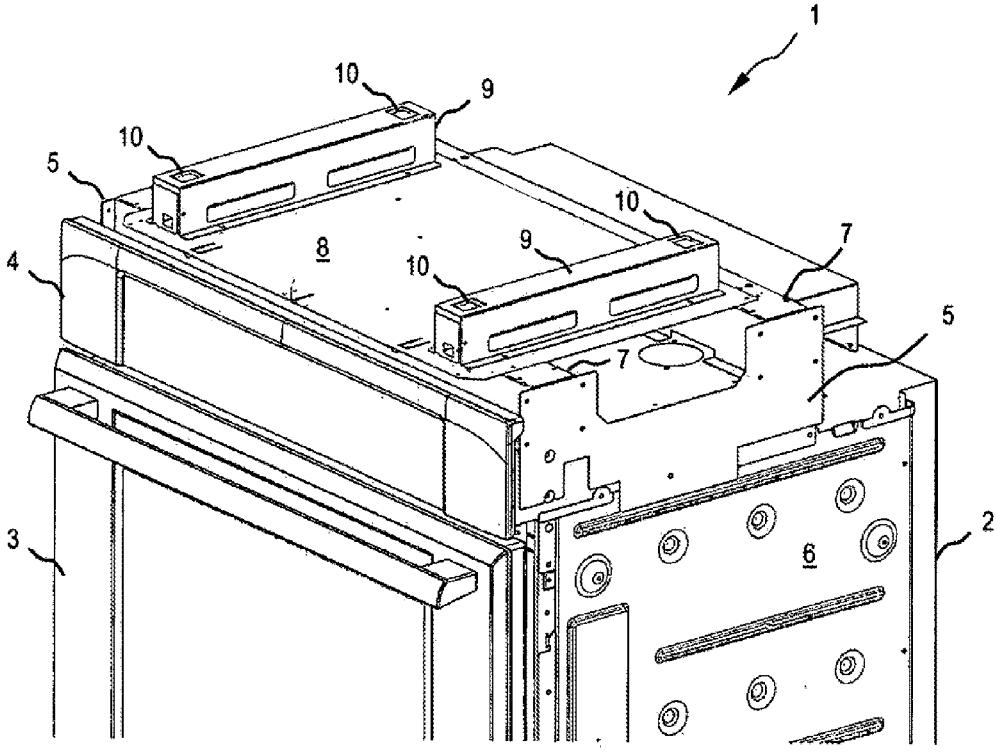
FIG. 1 shows a domestic appliance combination in a first assembly stage inclined obliquely to the right in front.

FIG. 1 shows an oven 2 of a domestic appliance combination 1 obliquely from the front right, which is provided for installation into built-in housing (not shown), namely in a first assembly stage of the preassembly of support parts. The oven 2 has an oven door 2 on the front side, above which a panel 4 is arranged. A gusset plate 5 is arranged on the side of the oven 2 in each instance, which is set up to control a weight acting thereupon into a wall of the oven 2, here a side panel 6 arranged therebelow. The gusset plates 5 are connected by means of two cross arms 7, on which a lower air baffle 8 is disposed for the microwave to be mounted above the oven. Support profiles 9 for supporting the microwave to be mounted are disposed on the lower air baffle 8 extending from the front to the back. The support profiles 9 can be produced separately or can be produced at least partially in one piece with the air baffle 8. The support profiles 9 have recesses 10 for the feet of the microwave. The gusset plate 5, the cross arms 7 and the support profiles 9 thus represent a support structure, which distances the microwave to be mounted from the oven 2. The panel 4 covers this support structure and can be regarded as being a part thereof. Alternatively, the panel can comprise display and control elements of one of both devices.

Figure 2:
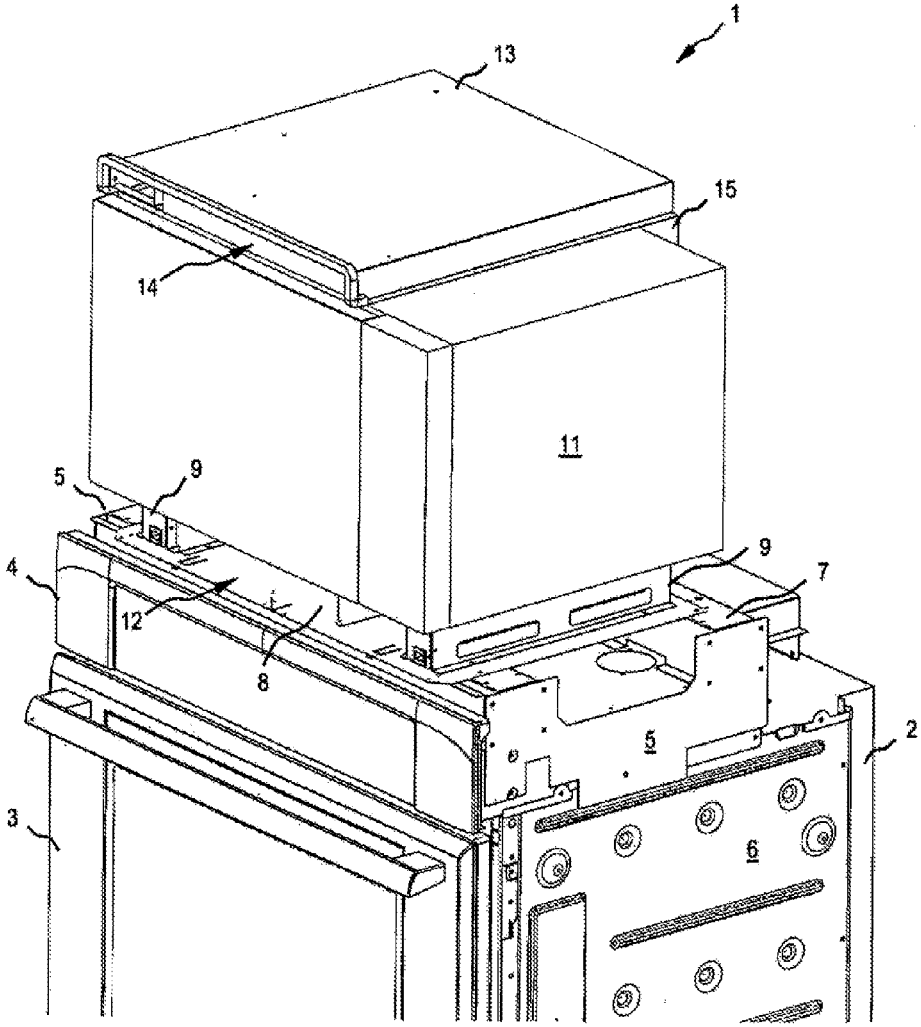
FIG. 2 shows the domestic appliance combination of FIG. 1 in a more advanced assembly stage.

FIG. 2 shows the domestic appliance combination 1 in a view which is similar to that in FIG. 1 in a further assembly stage with a microwave 11, which is disposed on the support profile 9 such that its feet fit into the recesses, as a result of which the microwave 11 is arranged on the oven 2. As the support profiles 9 distance the lower wall of the microwave 11 from the lower air baffle 8, a lower guide channel 12 is herewith created over essentially the entire width of the microwave 11. An upper air baffle 13 is also distanced from an upper device wall of the microwave 11, as a result of which an upper air guide channel is created over essentially the entire width of the microwave 11. In addition, a rear air baffle 15 is mounted at a distance from a rear device wall of the microwave 11, as a result of which a rear air guide channel (not shown) is created over essentially the entire width of the microwave 11. The air channels produce an adequate cooling air volume to cool the device walls.

Figure 3:
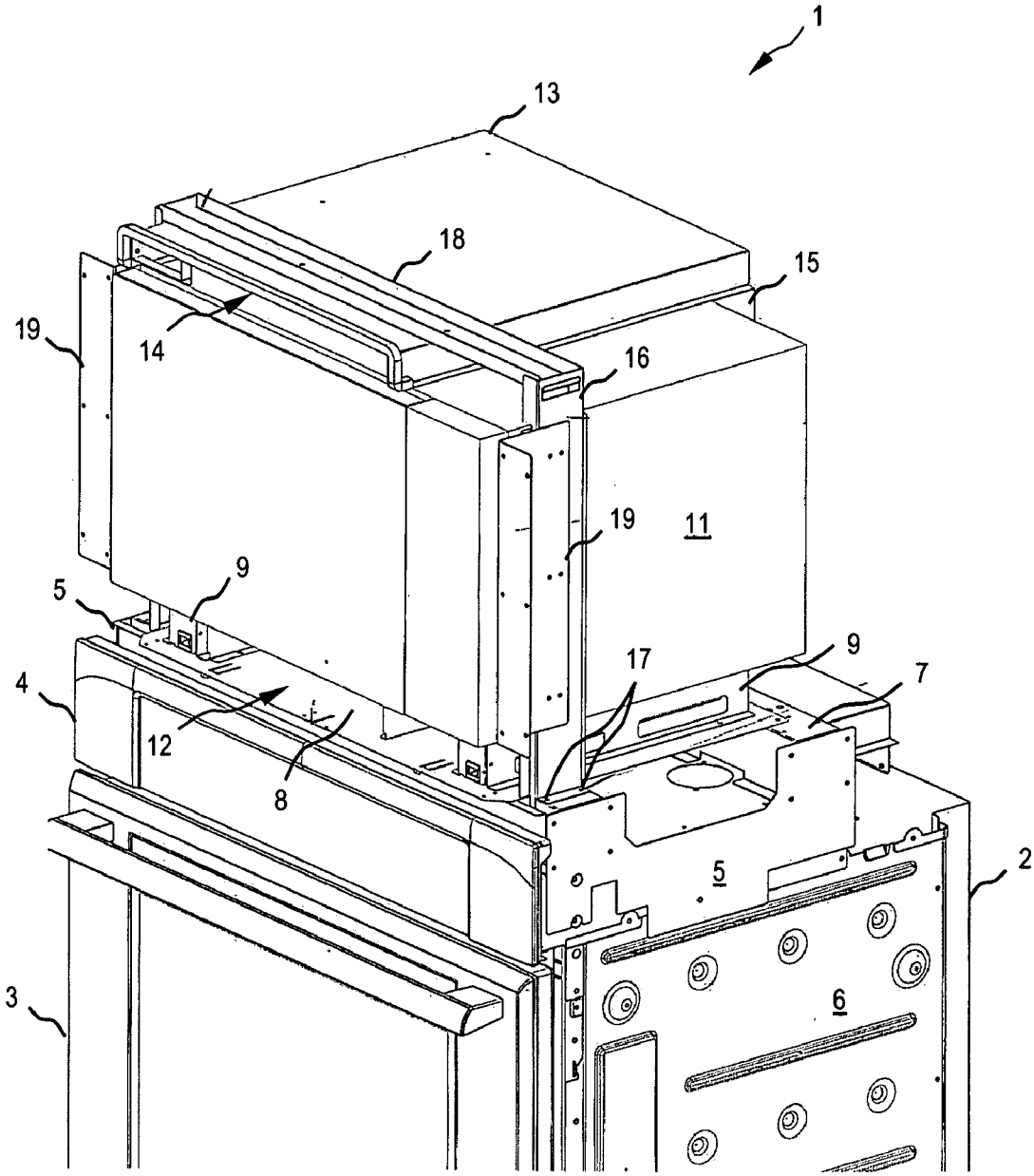
FIG. 3 shows the domestic appliance combination of FIG. 2 in an even more advanced assembly stage.

FIG. 3 shows the domestic appliance combination 1 in a view similar to that in FIGS. 1 and 2 in a further assembly stage, in which the microwave 11 is only clamped for fastening purposes. To this end, a left-hand and right-hand bracket 16 are fastened to the front cross arm by way of screw-connection points 17 (two per side), such that they run laterally up the microwave 11 in each instance and extend beyond its top side. The left-hand and right-hand brackets 16 have slotted recesses (without reference characters) in an upper region, by means of which an upper clamping bracket 18 is engaged. In this way, the upper clamping bracket 18 is on the topside of the microwave 11 under tension such that it presses this against the support profile 9. A clamping fixture is thus created for the microwave 11 by the brackets 16, 18. This fixture can be easily opened, particularly without releasing a screw connection and subsequently the microwave 11 can be easily assembled and reassembled.

In an alternative embodiment, the right and left brackets can also be engaged or locked in an associated support part and/or base, such as for instance a cross arm, instead of being attached by screwing for instance. A screwing step is herewith saved during the assembly, however assembly and maintenance are as such more difficult to manage.

Two or even more bracket fixtures 16, 18 can also be used.

Figure 4:
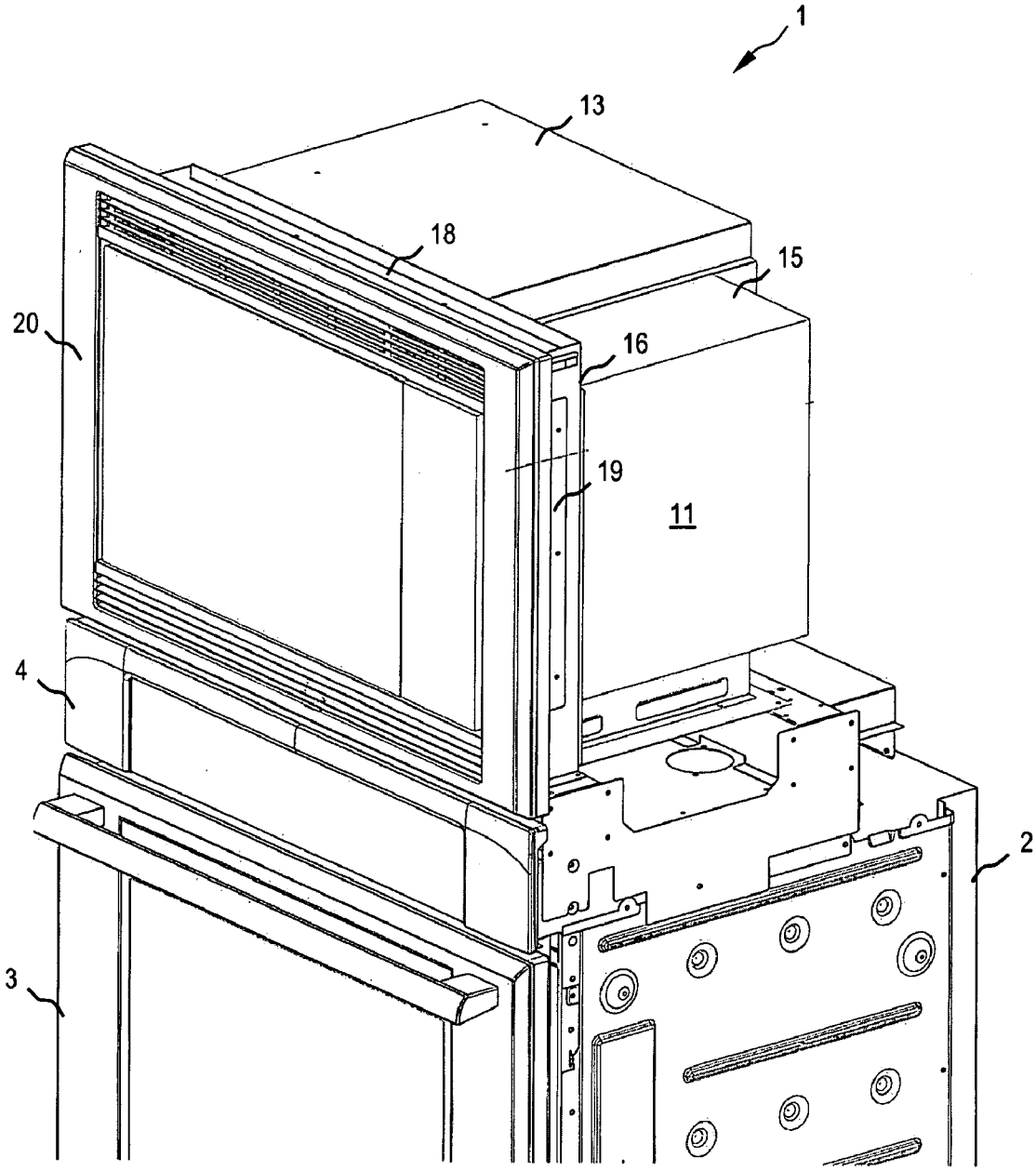
FIG. 4 shows the domestic appliance combination of FIG. 1 in a completed preassembled assembly stage.

A frame holder 19 is attached to the outside of the bracket 16 in each instance, which is provided to attach a decor frame (see FIG. 4).

FIG. 4 shows the domestic appliance combination from the FIGS. 1 to 3 in a completed preassembled assembly stage for insertion and/or installation into a common built-in housing (not shown). The common built-in housing can in particular be a housing, which has no separating structures, e.g. separating walls, for separating the oven and the microwave. In comparison to FIG. 3, a décor frame has now been disposed on the frame holder, said décor frame comprising ventilation slits (without reference characters) assigned to the lower and upper air guide channels.

The above exemplary embodiment is not to be understood as restrictive. Other support constructions can be used for instance. The invention is also not restricted to a combination of oven and microwave, but can also include other domestic appliances, e.g. two ovens. The invention is also not restricted to a combination of two domestic appliances but can also include more domestic appliances, which are connected to one another accordingly.

LIST OF REFERENCE CHARACTERS

1 Domestic appliance combination
2 Oven
3 Oven door
4 Panel
5 Gusset plate
6 Side panel
7 Cross arm
8 Lower air baffle
9 Support profile
10 Recess
11 Microwave
12 Lower air guide channel
13 Upper air baffle
14 Upper air guide channel
15 Rear air baffle
16 Bracket
17 Screw-connection points
18 Upper clamping bracket
19 Frame holder
20 Décor frame

The invention claimed is:

1. A domestic appliance combination, comprising:

a first domestic appliance;

a second domestic appliance, the second domestic appliance being arranged above the first domestic appliance and the second domestic appliance and the first domestic appliance together forming a connected unit adapted for installation into a common built-in housing;

a support structure secured to the first domestic appliance; and a clamp connection for securing the second domestic appliance to the first domestic appliance, the clamping connection including a first side bracket connected at its lower end to the support structure and extending upward along a first side of the second domestic appliance, a second side bracket connected at its lower end to the support structure and extending upward along a second side of the second domestic appliance, the second side being opposite the first side, and an upper clamping bracket removably connected to an upper end of the first side bracket and an upper end of the second side bracket, wherein the upper clamping bracket is connected to the upper end of the first side bracket by a non-threaded connection such that the upper clamping bracket can be disconnected from and reconnected to the first side bracket without damaging the upper clamping bracket or the first side bracket.

2. The domestic appliance combination as claimed in claim 1, wherein the support structure is disposed between the first domestic appliance and the second domestic appliance, the support structure being supported by the first domestic appliance and supporting the second domestic appliance on the first domestic appliance.

3. The domestic appliance combination as claimed in claim 2, wherein the support structure forms at least a portion of an air channel directly below the second domestic appliance.

4. The domestic appliance combination as claimed in claim 1, further comprising air channels mounted on the second domestic appliance.

5. The domestic appliance combination as claimed in claim 1, wherein the first domestic appliance is a non-microwave oven, and the second domestic appliance is a microwave oven, arranged above the first domestic appliance and the ovens are adapted for installation into a common built-in housing.

6. The domestic appliance combination as claimed in claim 1, wherein the connected unit of the first domestic appliance and the second domestic appliances is built into a common built-in housing.

7. The domestic appliance combination as claimed in claim 1, wherein the second domestic appliance is removable from the first domestic appliance when the upper clamping bracket is disconnected from the first side bracket.

8. The domestic appliance combination as claimed in claim 7, wherein the upper clamping bracket is connected to the upper end of the first side bracket by a tab on the upper clamping bracket engaging a slotted recess in the first side bracket.

9. The domestic appliance combination as claimed in claim 8, wherein the upper clamping bracket applies a force to a top of the second domestic appliance such that the second domestic appliance is pressed against the support structure.

10. The domestic appliance combination as claimed in claim 1, wherein the upper clamping bracket is connected to the upper end of the first side bracket by a tab on the upper clamping bracket engaging a slotted recess in the first side bracket.

11. The domestic appliance combination as claimed in claim 10, wherein the upper clamping bracket applies a force to a top of the second domestic appliance such that the second domestic appliance is pressed against the support structure.

12. The domestic appliance combination as claimed in claim 1, wherein the upper clamping bracket applies a force to a top of the second domestic appliance such that the second domestic appliance is pressed against the support structure.

13. The domestic appliance combination as claimed in claim 3, further comprising a lower air baffle that separates the air channel directly below the second domestic appliance from an air channel directly above the first domestic appliance.

14. The domestic appliance combination as claimed in claim 13, wherein the lower air baffle is a part of the support structure.

15. A method for connecting at least two domestic appliances one above the other, the method comprising:

providing a plurality of domestic appliances including at least a first domestic appliance and a second domestic appliance;

securing a support structure to the first domestic appliance; and fastening at least the first domestic appliance to the second domestic appliance via a clamp connection, the clamping connection including a first side bracket connected at its lower end to the support structure and extending upward along a first side of the second domestic appliance, a second side bracket connected at its lower end to the support structure and extending upward along a second side of the second domestic appliance, the second side being opposite the first side, and an upper clamping bracket removably connected to an upper end of the first side bracket and an upper end of the second side bracket, wherein the upper clamping bracket is connected to the upper end of the first side bracket by a non-threaded connection such that the upper clamping bracket can be disconnected from and reconnected to the first side bracket without damaging the upper clamping bracket or the first side bracket.

16. The method as claimed in claim 15, wherein the support structure is adapted to accommodate the second domestic appliance and the fastening step includes attaching the second domestic appliance to the support structure via the clamp connection.

17. The method as claimed in claim 15, further comprising inserting the connected together first and second domestic appliances into a common built-in housing.

18. The method as claimed in claim 15, wherein the second domestic appliance is removable from the first domestic appliance when the upper clamping bracket is disconnected from the first side bracket.

19. The method as claimed in claim 18, wherein the upper clamping bracket is connected to the upper end of the first side bracket by a tab on the upper clamping bracket engaging a slotted recess in the first side bracket.

20. The method as claimed in claim 15, wherein the upper clamping bracket applies a force to a top of the second domestic appliance such that the second domestic appliance is pressed against the support structure.

* * * * *